US005528842A

United States Patent [19]

Ricci et al.

[11] Patent Number: 5,528,842

[45] Date of Patent: Jun. 25, 1996

[54] INSERT FOR A SHOE SOLE

[75] Inventors: Gordon K. Ricci, East Bridgewater; Christopher J. Pawlus, Northboro; Rebecca E. Snow, Sharon; Peter M. Foley, Needham; Paul E. Litchfield, Westboro; Spencer White, Easton, all of Mass.

[73] Assignee: The Rockport Company, Inc., Marlboro, Mass.

[21] Appl. No.: 450,670

[22] Filed: May 30, 1995

Related U.S. Application Data

[63] Continuation of Ser. No. 363,306, Dec. 22, 1994, abandoned, which is a continuation of Ser. No. 229,993, Apr. 19, 1994, abandoned, which is a continuation of Ser. No. 125,147, Sep. 23, 1993, abandoned, which is a continuation of Ser. No. 883,925, May 12, 1992, abandoned, which is a continuation of Ser. No. 829,617, Jan. 31, 1992, abandoned, which is a continuation of Ser. No. 774,165, Oct. 15, 1991, abandoned, which is a continuation of Ser. No. 701,577, May 14, 1991, abandoned, which is a continuation of Ser. No. 617,289, Nov. 21, 1990, abandoned, which is a continuation of Ser. No. 307,460, Feb. 8, 1989, abandoned.

[51] Int. Cl.[6] ..... A43B 13/14

[52] U.S. Cl. ..... 36/27; 36/28; 36/30 R; 36/38; 36/103

[58] Field of Search ..... 36/7.8, 27, 28, 36/25 R, 30 R, 34 R, 35 R, 36 B, 91, 92, 102, 103, 107, 108, 76 R, 76 C, 151; 128/586, 590, 592, 599, 614, 615, 620

[56] References Cited

U.S. PATENT DOCUMENTS

| | | | |
|---|---|---|---|
| 75,900 | 3/1868 | Hale et al. | 36/28 |
| 180,819 | 8/1876 | Ames . | |
| 340,358 | 4/1886 | Raymond, 2d . | |
| 413,693 | 10/1889 | Walker | 36/28 |
| 634,588 | 10/1899 | Roche . | |
| 673,869 | 5/1901 | Hampel et al. | 36/28 |
| 741,012 | 10/1903 | Corey | 36/28 |
| 885,163 | 5/1907 | Cotter | 128/620 |
| 891,090 | 6/1908 | Mitchell | 36/27 |
| 968,020 | 8/1910 | Yandoli | 36/27 |
| 1,387,411 | 8/1921 | Kolkebeck . | |
| 2,383,877 | 8/1945 | Miller . | |
| 2,529,818 | 11/1950 | Ryan . | |
| 3,999,558 | 12/1976 | Barnwell et al. . | |
| 4,224,749 | 9/1980 | Diaz-Cano | 36/34 R |
| 4,316,335 | 2/1982 | Giese et al. . | |
| 4,372,059 | 2/1983 | Ambrose | 36/32 R |
| 4,391,048 | 6/1983 | Lutz . | |
| 4,439,937 | 4/1984 | Daswick . | |
| 4,492,046 | 1/1985 | Kosova | 36/27 |
| 4,561,195 | 12/1985 | Onoda et al. . | |
| 4,566,206 | 1/1986 | Weber | 36/27 |
| 4,592,153 | 6/1986 | Jacinto . | |
| 4,638,575 | 1/1987 | Illustrato . | |
| 4,771,554 | 9/1988 | Hannenmann . | |
| 4,782,605 | 11/1988 | Chapnick . | |
| 4,815,221 | 3/1989 | Diaz . | |

(List continued on next page.)

FOREIGN PATENT DOCUMENTS

| | | | |
|---|---|---|---|
| 165954 | 3/1950 | Austria . | |
| 891679 | 3/1944 | France . | |
| 958706 | 3/1950 | France . | |
| 2507066 | 12/1982 | France . | |
| 2517526 | 6/1983 | France . | |
| 813193 | 7/1949 | Germany . | |
| 3635831A1 | 5/1988 | Germany | 36/30 R |
| 62-170038 | 10/1987 | Japan . | |
| 63-19304 | 2/1988 | Japan . | |
| 1-274705 | 11/1989 | Japan . | |
| 1-164804 | 11/1989 | Japan . | |
| 92309 | 3/1938 | Sweden . | |
| 277637 | 9/1951 | Switzerland . | |
| 1081988 | 9/1967 | United Kingdom . | |
| WO87/07481 | 12/1987 | WIPO . | |

*Primary Examiner*—John P. Darling
*Attorney, Agent, or Firm*—Sterne, Kessler, Goldstein & Fox

[57] ABSTRACT

An insert for a shoe sole includes a heel lever which absorbs energy from the foot during heel strike and returns the energy to the foot during heel lift-off.

20 Claims, 8 Drawing Sheets

U.S. PATENT DOCUMENTS 4,831,750 5/1989 Müller .
4,852,273 8/1989 Hamy ..... 36/28
4,854,057 8/1989 Misevich et al. .
4,878,300 11/1989 Bogaty .
4,881,329 11/1989 Crowley .
5,052,130 10/1991 Barry et al. .
5,185,943 2/1993 Tong et al. .
5,191,727 3/1993 Barry et al. .
5,255,451 10/1993 Tong et al. .
5,315,769 5/1994 Barry et al. .
5,319,866 6/1994 Foley et al. .
5,390,430 2/1995 Fitchmun et al. .

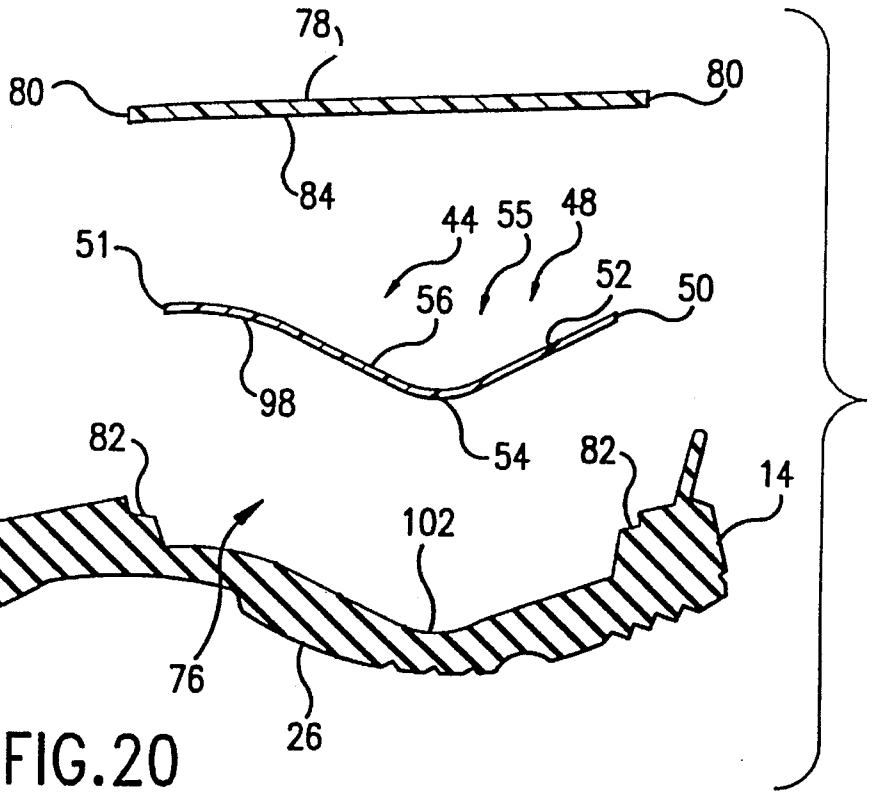
FIG.20
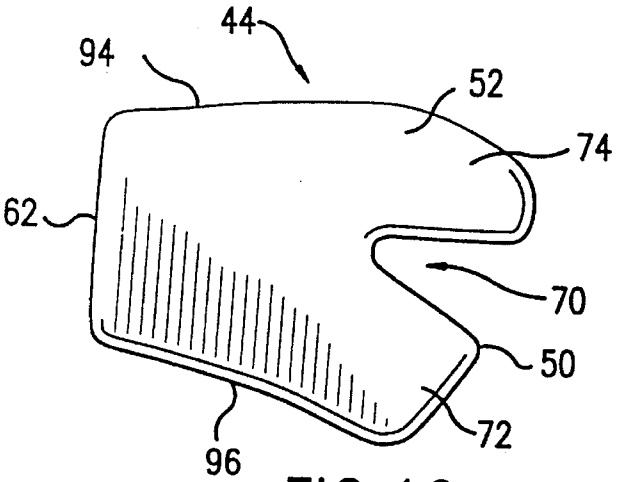
FIG.19
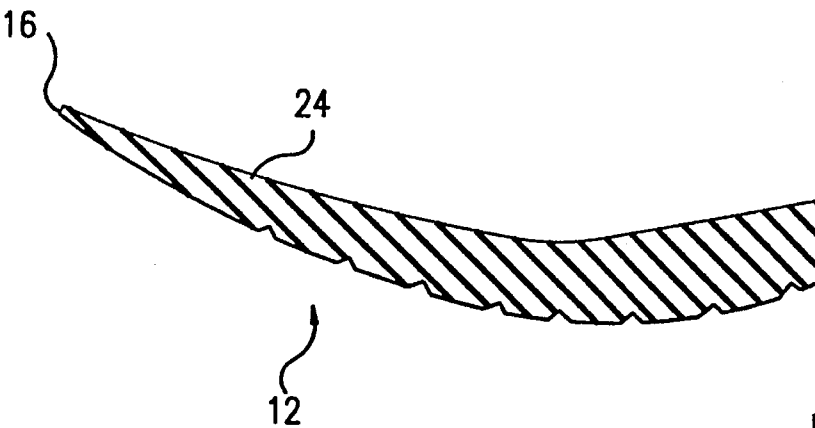

INSERT FOR A SHOE SOLE

RELATED U.S. APPLICATIONS

This application is a continuation of application Ser. No. 08/363,306, filed Dec. 22, 1994, now abandoned, which is a continuation of application Ser. No. 08/229,993, filed Apr. 19, 1994, now abandoned, which is a continuation of application Ser. No. 08/125,147, filed Sep. 23, 1993, now abandoned, which is a continuation of application Ser. No. 07/883,925, filed May 12, 1992, now abandoned, which is a continuation of application Ser. No. 07/829,617, filed Jan. 31, 1992, now abandoned, which is a continuation of application Ser. No. 07/774,165, filed Oct. 15, 1991, now abandoned, which is a continuation of application Ser. No. 07/701,577, filed May 14, 1991, now abandoned, which is a continuation of application Ser. No. 07/617,289, filed Nov. 21, 1990, now abandoned, which is a continuation of application Ser. No. 07/307,460, filed Feb. 8, 1989, now abandoned.

FIELD OF THE INVENTION

The present invention relates to an insert for a shoe, and more particularly to an insert which responds to shifts in body weight in a similar manner as the longitudinal arch of a human foot.

BACKGROUND OF THE INVENTION

One of the major concerns of the footwear industry is constructing shoes which are comfortable. After all, if a shoe is uncomfortable, the purchaser will be unable to wear the shoe and the reputation of the manufacturer will be tarnished. In order to design a comfortable shoe, it is necessary that the shoe designer take into consideration the structure of the foot and the function of particular elements of that structure.

The human foot has to combine the two functions of: (1) supporting the weight of the body while keeping it properly balanced; and (2) propelling the body forward. One element of the foot which is particularly useful in combining the above functions is the longitudinal arch. Unfortunately, the longitudinal arch has largely been ignored by shoe designers.

Referring to FIG. 1, the longitudinal arch A, which is useful for both shock absorption and propulsion, extends from the calcaneum C or heel bone to the heads of the metatarsal bones M of the foot. When standing, the weight of the body is borne by areas of the foot other than the longitudinal arch, causing the longitudinal arch to extend longitudinally, becoming longer and lower to the ground.

During walking, the entire body weight is taken by each foot in turn and is transferred from heel to toe as the center of gravity of the body moves in relation to the ground. The first part of the foot to contact the ground is the heel, and the term used to describe this stage of foot propulsion is "heel strike." The calf muscles then lower the remainder of the foot down in relation to the leg. During the body weight shifting stages of foot propulsion following heel strike, the longitudinal arch acts as a rubber band. That is, it goes through a series of dimensional changes which are both tiring and stressful to the foot.

First, the foot is lengthened, causing the inner longitudinal arch to lengthen and flatten. As the body weight continues to be transferred toward the metatarsal bones, and the muscles of the foot contract, the inner longitudinal arch is raised and shortened. This stage is commonly termed "heel lift-off." In the final stage of propulsion, commonly termed "toe-off," the inner longitudinal arch is then used as a lever to lift the body at the joint of the big toe and propel the foot forward.

Heretofore, various devices have been proposed which are designed to assist the dimensional changes of the inner longitudinal arch during propulsion and to relieve fatigue of the foot. One example of such a device is disclosed in U.S. Pat. No. 634,588 to Roche, which describes an arch support for a shoe. The support comprises a spring plate which is placed upon the insole of the shoe. The plate is curved to conform to the arch of the foot. One end of the plate is attached to the shoe at the heel end. The other end of the plate is freely moveable. When pressure from the foot is applied to and released from the spring, as during walking, the free end of the spring moves along the length of the insole and the spring is allowed to flatten and raise respectively.

While the device of the Roche patent may provide a yielding support for the arch and a portion of the heel of the foot, it suffers from several disadvantages which are overcome by the present invention. For example, the spring of the Roche patent does not begin to flatten until the forefoot has contacted the ground and the body weight has shifted. Therefore, the arch support provided by the Roche spring is not effectuated until the body weight is already positioned over the spring. The arch support of the present invention begins to flatten at heel strike, before the forefoot contacts the ground thereby, providing spring to the foot. Hence, as the longitudinal arch lends spring to the foot so does the arch support of the present invention.

Furthermore, the Roche spring is used in combination with a non-yielding shoe sole which may cause the foot to experience shock when it contacts the ground. In contrast the arch support of the present invention may be used in combination with a yielding shoe sole and therefore, provides added cushioning for the foot. Moreover, in the Roche patent there is no provision of a heel lever which absorbs energy from heel-strike and returns energy to the heel during heel lift-off. Hence, much of the energy generated during heel-strike is lost.

Therefore, the need exists for an arch support which responds to body weight shifting in the same manner as the longitudinal arch of a human foot, i.e., one which begins deflection as soon as body weight transfer has begun. Also, the need exists for an arch support which is provided in combination with a yielding shoe sole so that the shock associated with ground contact is eliminated. Furthermore, the need exists for a heel support which cushions the heel and which absorbs energy from heel-strike and returns that energy to the heel at heel lift-off.

SUMMARY OF THE INVENTION

The present invention comprises an insert for an article of footwear. The insert includes a heel support which absorbs shock from the foot and returns energy during the gait cycle. The insert may have an arch support which generally follows the longitudinal arch of the foot. The arch support flattens in response to pressure from the foot. The insert may be placed in a cavity formed within a sole body of an article of footwear. A plate comprising a moderator may be disposed above the insert.

BRIEF DESCRIPTION OF THE FIGURES

The foregoing and other objects and advantages of the present invention will be more fully appreciated as the same become better understood from the following detailed description of the present invention, when considered in conjunction with the accompanying drawings in which:

FIG. 19 is a top plan view of a further embodiment of the insert of the present invention; and FIG. 20 is a side elevational view of a cross-section of a shoe sole incorporating the insert embodiment of FIG. 19.

DETAILED DESCRIPTION OF THE PREFERRED EMBODIMENTS

Figure 1:
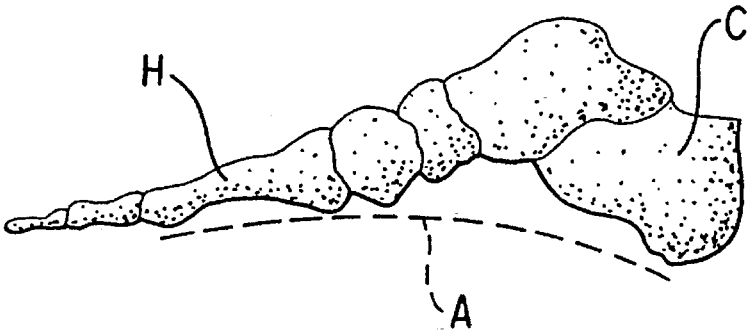
FIG. 1 is a side elevational view of a foot skeleton.
Figure 2:
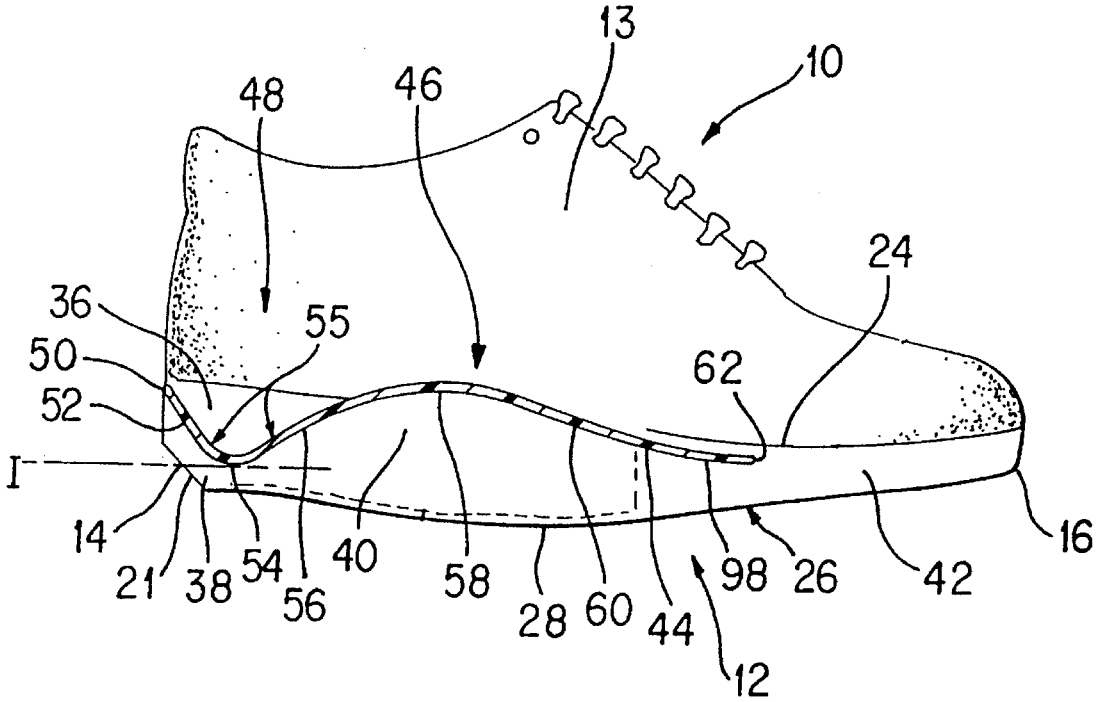
FIG. 2 is a cross sectional view of a shoe for the right foot incorporating one embodiment of the present invention.

Referring now to the drawings, in which similar reference numerals have been used to refer to similar elements, and in particular to FIG. 2, a shoe incorporating one embodiment of the present invention is shown generally at 10. A variety of shoe structures are capable of incorporating the principles of the present invention. However, it is preferred that the shoe include a sole body, shown generally at 12. While an upper 13 has been shown attached to sole body 12, it should be understood that the present invention is not limited to the upper structure which has been shown. Furthermore, while FIGS. 2 and 3 show a shoe for the right foot, it should be understood that the shoe incorporating the principles of the present invention for the left foot would be a mirror image of the shoe which is shown.

FIG. 2 shows one embodiment of the arch propulsion system of the present invention. The arch propulsion system comprises insert 44 which is disposed within sole body 12. In the embodiment shown in FIG. 2, arch support surface 58 of insert 44 may extend above the last line of shoe 10, i.e., the line at which upper 13 is joined to sole body 12. Referring to FIGS. 2 and 3, sole body 12 is defined by a heel end 14, a toe end 16, medial side 18, and lateral side 20. Sole body 12 may comprise an outsole, a midsole, an insole, or any combination thereof. Sole body 12 has a thickness which is defined by a foot supporting or top surface 24 and a ground contacting or bottom surface 26. Although not shown, a separate outsole layer may be provided on ground contacting surface 26.

Ground contacting surface 26 is shown in FIG. 2 as having a rocker bottom 28, i.e., a semi-circular area underneath the arch which provides a mound upon which the foot rolls when walking. Rocker bottom 28 may be disposed beneath the ball or metatarsal bones of the foot, or any other area of ground contacting surface 26. Rocker bottom 28 is not essential to the present invention, however, and therefore a shoe embodying the principles of the present invention could very well have a flat sole. In addition, although not necessary, medial side 18, as shown in FIG. 3, may flare outwardly from sole body 12 to help prevent heel pronation. Lateral side 20 may also flare outwardly for improved stability. Furthermore, although not necessary, angled walls 21, 23 and 25 may be formed within sole body 12 adjacent the bottom of heel end 14, medial side 18 and lateral side 20 of sole body 12, respectively, as shown in FIGS. 2 and 3. Angled walls 21, 23 and 25 result in a sole body construction wherein insert 44 is disposed closer to ground contacting surface 26, and the impact forces on sole body 12 during heel strike are localized upon insert 44. The localized and increased impact forces upon insert 44 may enhance the flexibility and hence the energy return characteristics of insert 44.

Figure 3:
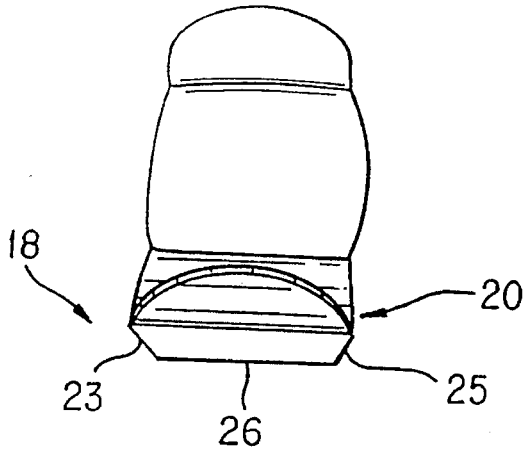
FIG. 3 is a rear view of the shoe of FIG. 2.

As shown in FIG. 3, insert 44 may extend the full width of sole body 12 from medial side 18 to lateral side 20. However, it is preferred that insert 44 only traverse a portion of the width of sole body 12 (see e.g., FIGS. 16–18). If desired, heel end 14, toe end 16, medial side 18, lateral side 20, top surface 24 and/or bottom surface 26 of sole body 12 may include a "window" or similar see-through construction, in order to make insert 44 of the present invention visible from the exterior of shoe 10.

With continuing reference to the embodiment of FIGS. 2–5, insert 44 comprises a leaf spring comprising an arch support, shown generally at 46, and a V-shaped heel support, shown generally at 48. V-shaped heel support 48 is defined by a heel lever 52 and heel incline surface 56, which form a recess 55. V-shaped heel support 48 has a heel terminus 50 and a fulcrum 54. Fulcrum 54 is disposed at the junction of heel incline surface 56 and heel level 52. Fulcrum 54 supports heel support 48, which absorbs energy from the foot during heel strike. Heel incline surface 56 receives pressure from the heel during heel strike, causing it to deflect. These and other aspects of the present invention are described in greater detail below.

Arch support 46 is defined by a forward end 62, an arch decline surface 60, an arch support surface 58, and a bottom surface 98. Arch support surface 58 is arcuate, and preferably generally follows the curvature of the longitudinal arch of a human foot. Fulcrum 54 lies in a plane lower than arch support surface 58 when insert 44 is in use. Arch support surface 58 deflects or flexes, i.e., lengthens and flattens, when pressure is applied to heel incline surface 56 and to arch support surface 58 itself. Similarly, arch support surface 58 rises, i.e., shortens and curves, when pressure is relieved from arch support surface 58. This allows arch support surface 58 to respond to body weight shifting in the same manner as the longitudinal arch of the human foot, and thereby assist the foot during propulsion.

Figure 4:
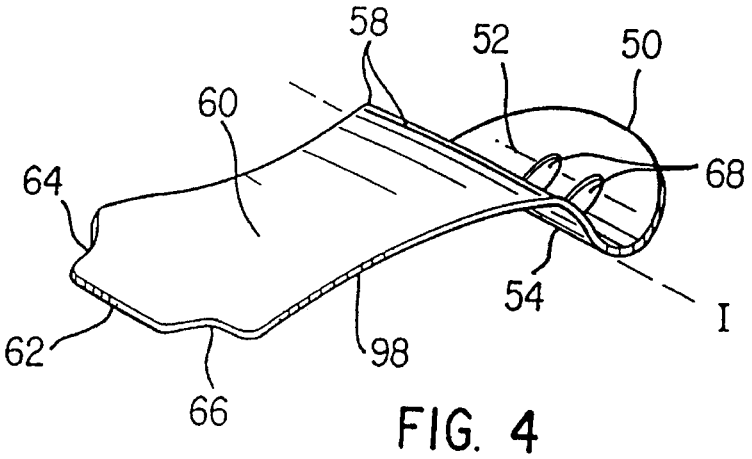
FIG. 4 is a perspective view of the insert of FIG. 2 taken from the front of the insert.
Figure 5:
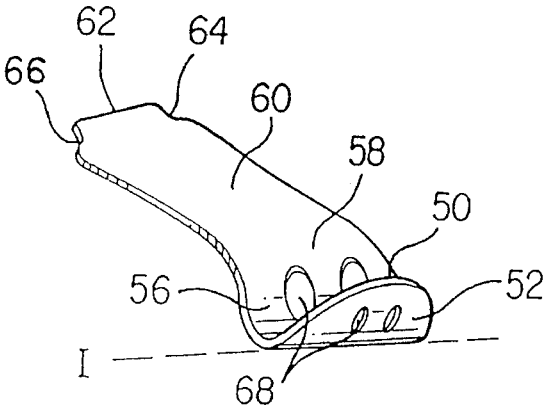
FIG. 5 is a perspective view of the insert of FIG. 2 taken from the rear of the insert.

As shown in the embodiment of FIGS. 4 and 5, a medial taper 64 and a lateral taper 66 may be provided where arch decline surface 60 meets forward end 62. Through holes 68 may be provided along angled wall 52, heel incline surface 56, or any other portion of insert 44. Through holes 68 reduce the stiffness and the weight of insert 44. Also, if insert 44 is encapsulated within sole body 12 by molding, through holes 68 allow migration of material in order to achieve better adherence between sole body 12 and insert 44.

Figure 6:
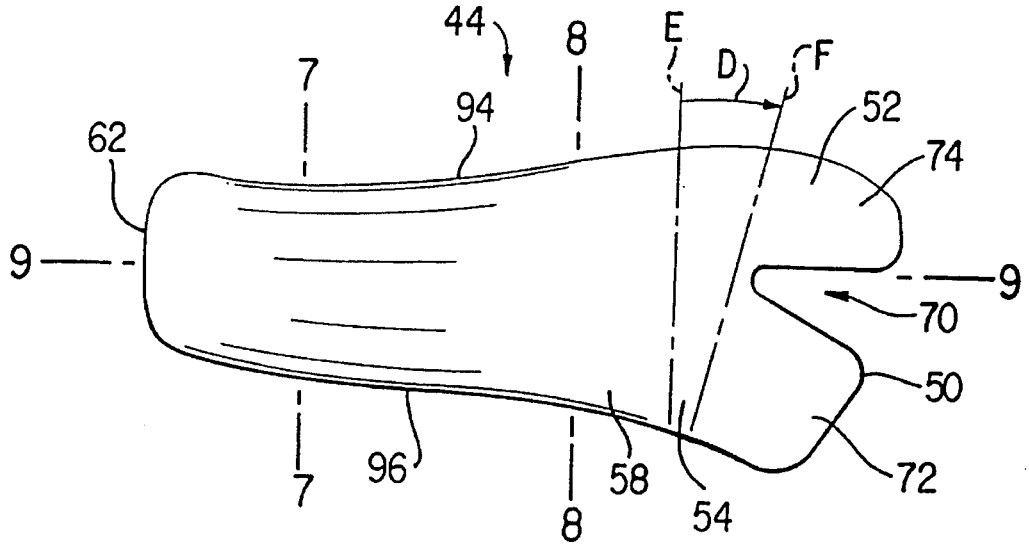
FIG. 6 is a top plan view of another embodiment of the insert of the present invention for incorporation within a shoe for the left foot.
Figure 7:
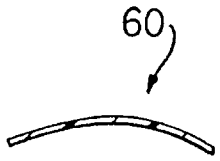
FIG. 7 is a cross-sectional view taken along line 7—7 in FIG. 6.
Figure 8:
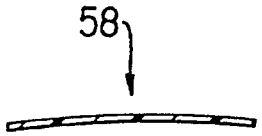
FIG. 8 is a cross-sectional view taken along line 8—8 in FIG. 6.
Figure 9:
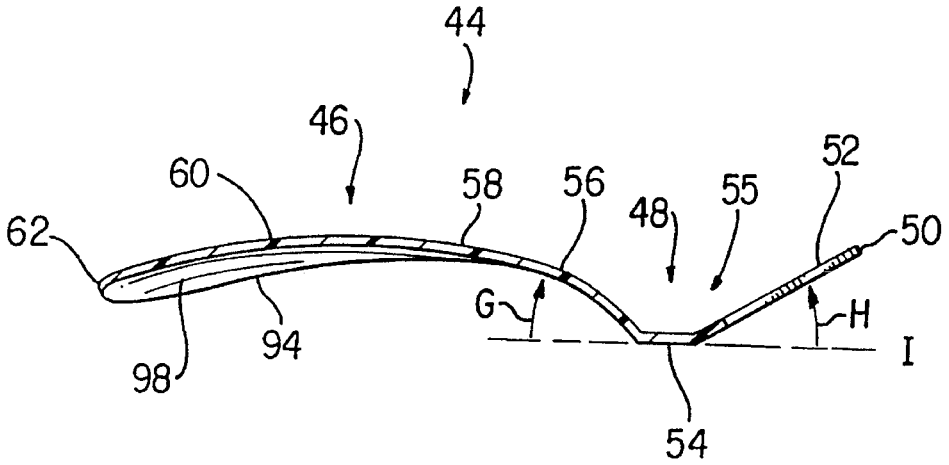
FIG. 9 is a cross-sectional view taken along line 9—9 in FIG. 6.

FIGS. 6–10 show an alternate embodiment of the insert of the present invention. Although insert 44 of FIGS. 6–10 is for incorporation within a shoe for the left foot, an insert for use in a shoe for the right foot would be a mirror image of the insert which is shown. Referring to FIG. 6, insert 44 is slightly curved along its medial side 94 and lateral side 96, in order to more closely follow the outline of the human foot. Referring to FIG. 9, heel incline surface 56 forms an angle G with the horizontal axis I of fulcrum 54, which may equal approximately 42°. Similarly, heel lever 52 forms an angle H with horizontal axis I of fulcrum 54, which may equal approximately 30°.

Figure 11:
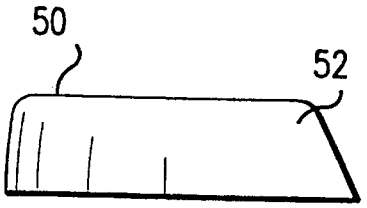
FIG. 11 is a rear view of an alternate embodiment of the insert of the present invention.
Figure 10:
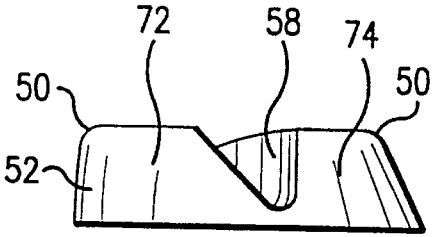
FIG. 10 is a rear view of the insert of FIG. 6.

As best shown in FIGS. 6 and 10, heel lever 52 may be divided by a cut-out 70 into two or more fingers 72, 74, and thereby have a substantially forked appearance. Fingers 72, 74 help reduce the weight and stiffness of insert 44, improve the flexibility of insert 44, and assist with rearfoot control. Whether insert 44 includes fingers 72, 74 (FIG. 10) or does not include fingers (FIG. 11), heel lever 52 may be disposed at an angle to the vertical axis E of insert 44, such that the surface area of fulcrum 54 is increased. For example, referring to FIG. 6, lines E and F form an angle D which may equal approximately 15°, and the area between dotted lines E and F comprises fulcrum 54. Comparing the embodiment of FIGS. 6–10 to that of FIGS. 2–5 (and particularly FIG. 9 to FIG. 2) fulcrum 54 of FIG. 9 has a larger surface area disposed along horizontal axis I than does fulcrum 54 of FIG. 2.

As previously described, arch support surface 58 of insert 44 generally follows the longitudinal curvature of the arch of the foot. In addition, arch support 46 may also include a lateral curvature extending between medial side 94 and lateral side 96 of insert 44. The embodiment of FIGS. 6–10 discloses such a "compound curvature" construction. As shown in these figures, the degree of lateral curvature of arch support 46 increases as one moves from arch support surface 58 toward forward end 62 of insert 44. If insert 44 includes a lateral curvature, insert 44 may be constructed such that arch support surface 58 generally follows the lateral curvature of the arch of the foot.

Insert 44 may be comprised of any suitable material which is flexible enough to deflect, yet stiff enough to avoid collapse when pressure from the foot is applied thereto. Furthermore, the deflection and stiffness characteristics of insert 44 will vary depending on the particular end use of the shoe in which insert 44 is incorporated. For example, when insert 44 is used in a running shoe, it may be necessary to increase the stiffness of the insert over that used in a shoe intended for walking.

Insert 44 is preferably formed of carbon-fiber composite. A woven graphite material, such as a carbon-glass weave, may be used. An epoxy resin may be poured over at least one surface of the weave. If a carbon-glass weave is used, the carbon material of insert 44 preferably runs in the anterior-posterior direction, while the glass is oriented in the medial-lateral direction. Two suitable composites for forming insert 44 are manufactured by Hexcel Corporation and BioMechanical Composites under product numbers XC1289 and TW1000, respectively. Other materials for use in making insert 44 include a carbon/aramid (KEVLAR)/glass composite, or an injection molded plastic polymer or composite. Examples of the latter material include Nylon 6,6 which may be fiberglass reinforced and sold under the trademark ZYTEL by E. I. Dupont de Nemours, Wilmington, Del. Other suitable materials include DELRIN and ARYLON. Suitable coatings include polypropelene, PELLETHANE (available from Dow Chemical Co.) or NUCREL (a resin available from E. I. DuPont de Nemours).

Sole body 12 may be made of any suitable flexible, elastomeric material which is capable of withstanding the friction generated when shoe 10 contacts the ground. The preferred material for sole body 12 is ethylene vinyl acetate (EVA). Molded polyurethane (PU) is another possible material.

Sole body 12 may be separated by insert 44 into several regions. In the embodiment shown in FIG. 2, an upper heel region 36 is defined by recess 55. A lower heel region 38 is defined by the area of the sole body 12 between heel lever 52, fulcrum 54, heel end 14 and a portion of ground contacting surface 26. An instep region 40, shown in dotted outline in FIG. 2, is defined in part by heel incline surface 56, arch support surface 58, and a portion of arch decline surface 60. A forefoot region 42 is defined by foot supporting surface 24, toe end 16 and a portion of ground contacting surface 28. Forefoot region 42 may connect with lower heel region 38 underneath instep region 40.

These regions may be comprised of material having a similar density, or they may be comprised of materials having varying density and compressibility. If materials having varying density and compressibility are used, it is possible to provide cushioning to particular areas of the foot and to provide support to others. One example of such would be to make upper heel region 36 of a material having a low density to provide cushioning for the heel during heel strike, e.g., a material having a shore C hardness of approximately 30 durometer. Similarly, lower heel region 38 may be comprised of a more dense material to support the heel during heel strike, e.g., one having a shore C hardness of approximately 50 durometer. Instep region 40 may be comprised of a less dense material, similar to the material used in upper heel region 36, thereby allowing arch support surface 58 to deflect when pressure from the foot is applied to insert 44. Forefoot region 42 may be comprised of a more dense material, similar to that forming heel region 38, to provide overall support to the foot.

In an alternate embodiment, instep region 40 could be void of material. In this instance, the material of the insert itself would provide the necessary resistance to the insert. This would also make sole body 12 lighter, and would allow greater flexing of insert 44. Furthermore, elastomeric material may be provided along foot supporting surface 24.

Figure 16:
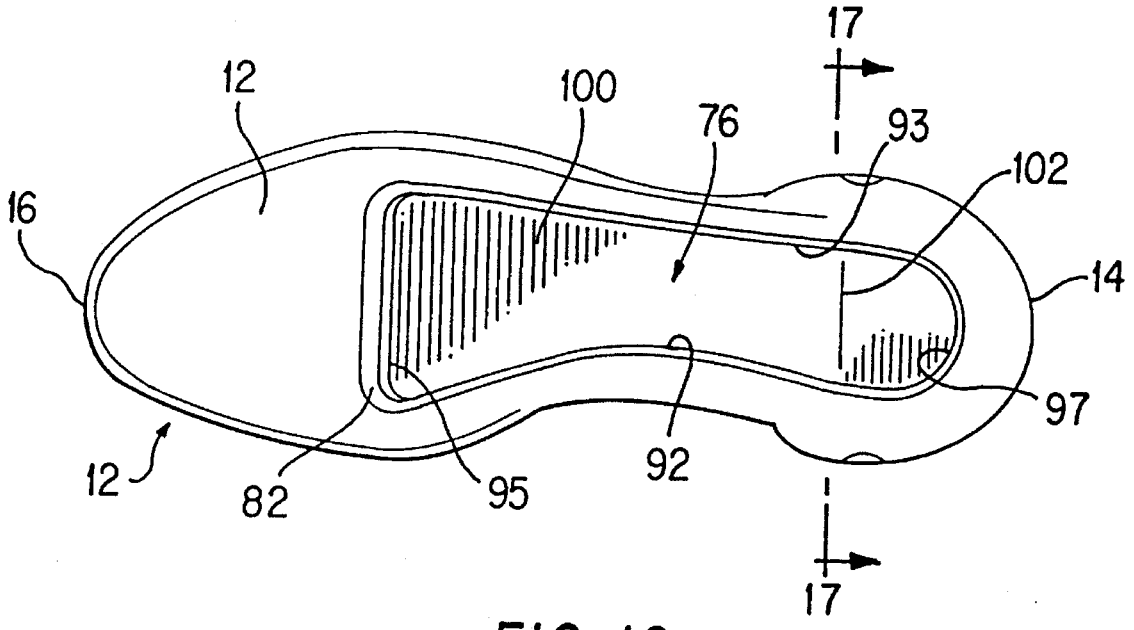
FIG. 16 is top plan view of the shoe sole of FIGS. 12 and 13.
Figure 17:
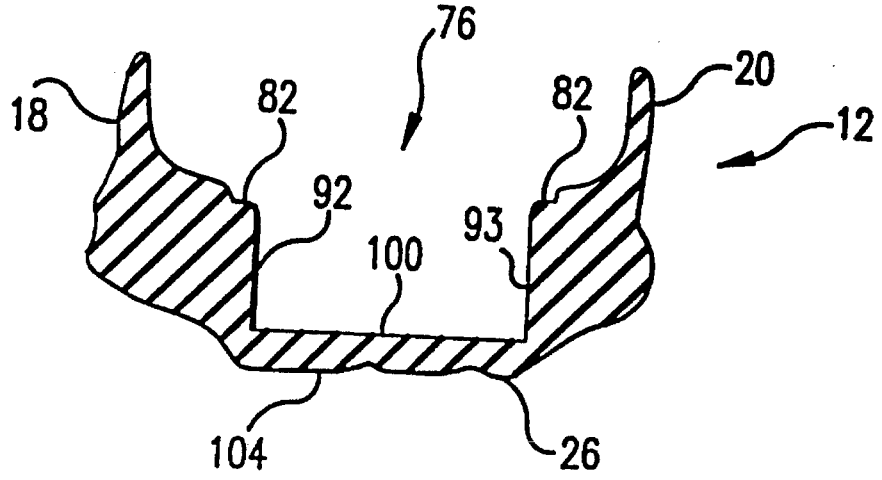
FIG. 17 is a cross-sectional view of the sole taken along line 17—17 in FIG. 16.
Figure 18:
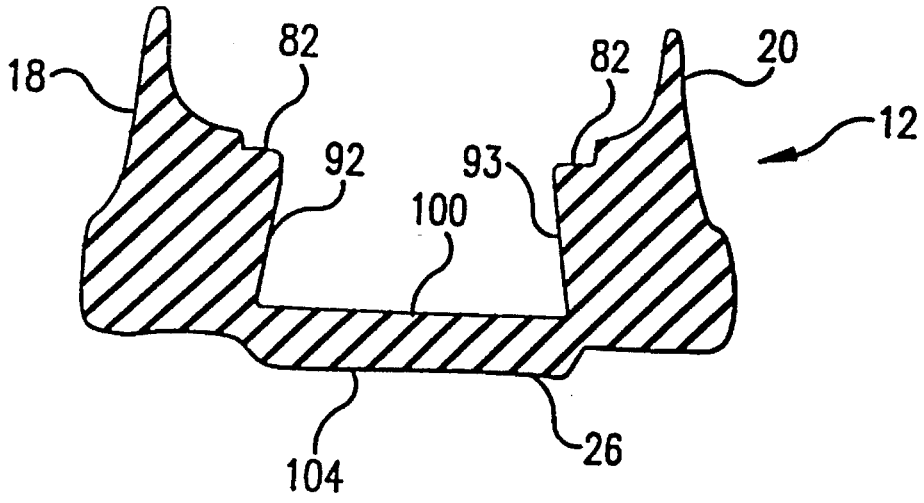
FIG. 18 is a cross-sectional view of an alternate embodiment of the shoe sole of the present invention.

In the preferred embodiment of the present invention, shown in FIGS. 12–18, insert 44 comprises a leaf spring which is completely disposed within a substantially hollow cavity 76 formed within sole body 12. Referring to FIGS. 12–13 and 16–18, cavity 76 is defined by sidewalls 92 and 93, front wall 95, rear wall 97, and insert support surface 100. Insert support surface 100 includes a fulcrum support surface 102. Insert 44 is retained within cavity 76 by walls 92, 93, 95 and 97 and insert support surface 100. Cavity 76 is shaped complementary to the shape of insert 44. Insert 44 rests upon the bottom of cavity 76, and the bottom surface 98 of insert 44 has a profile similar to that of insert support surface 100. Insert 44 only partially fills cavity 76. In this regard, referring to FIGS. 12, 13, insert 44 rests upon insert support surface 100, resulting in an open space or void 108 within cavity 76. In addition, as shown in FIG. 18, sidewalls 92 and 93 may be angled in order to better contain insert 44 within cavity 76, and form a larger notch area 82 (discussed below).

Referring particularly to FIGS. 16–18, both cavity 76 and insert 44 traverse only a portion of the width of sole body 12, and do not extend the full width of sole body 12 from medial side 18 to lateral side 20. It is preferred that sole body 12 beneath insert support surface 100, and particularly beneath fulcrum support surface 102, be relatively thin in order that insert 44 be in close contact with the ground or other support surface during use. Moreover, referring to FIGS. 12–13 and 17–18, sole body 12 includes a depressed heel area 104 adjacent fulcrum support surface 102. Depressed heel area 104 may be formed integrally with sole body 12, or may be a separate elastomeric piece secured to sole body 12. During heel strike, localized impact forces are placed upon depressed heel area 104, enhancing the energy return characteristics of insert 44.

Figure 12:
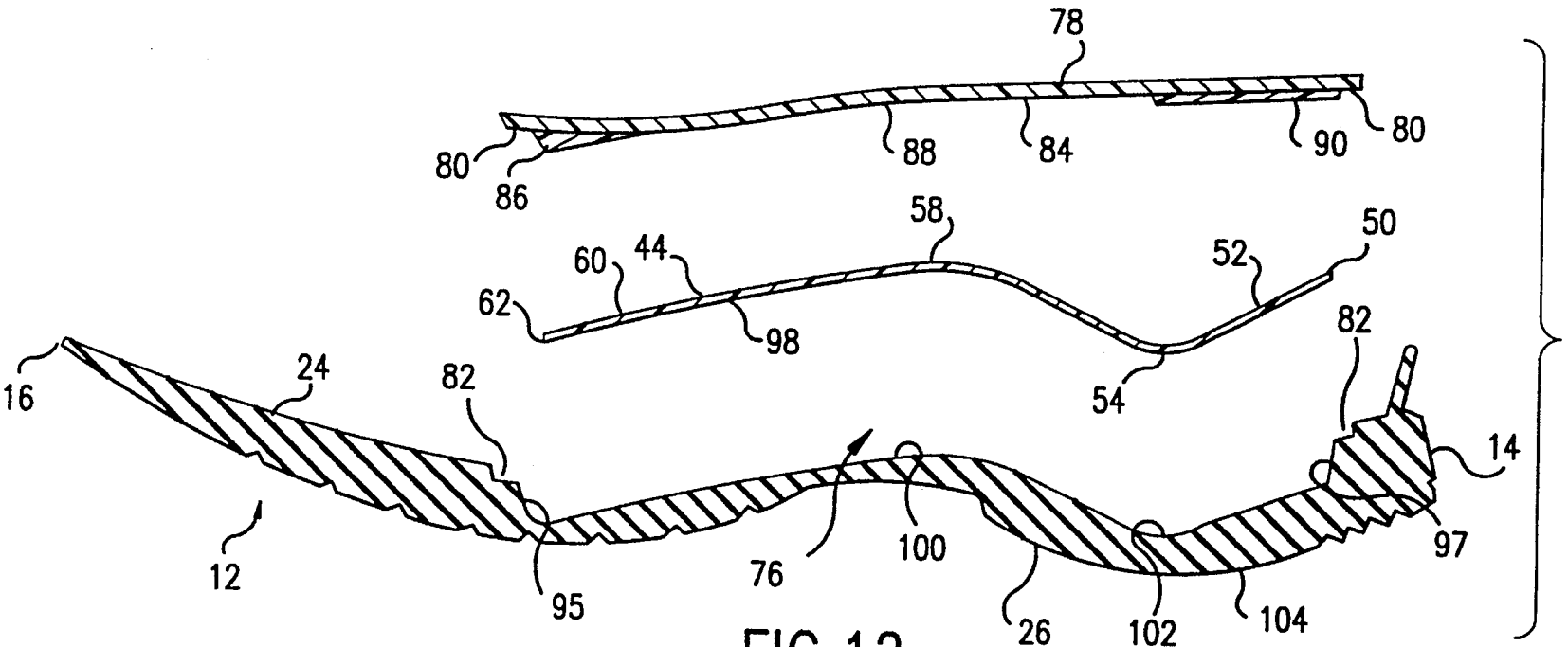
FIG. 12 is a side elevational view of a cross-section of a shoe sole incorporating the present invention.
Figure 13:
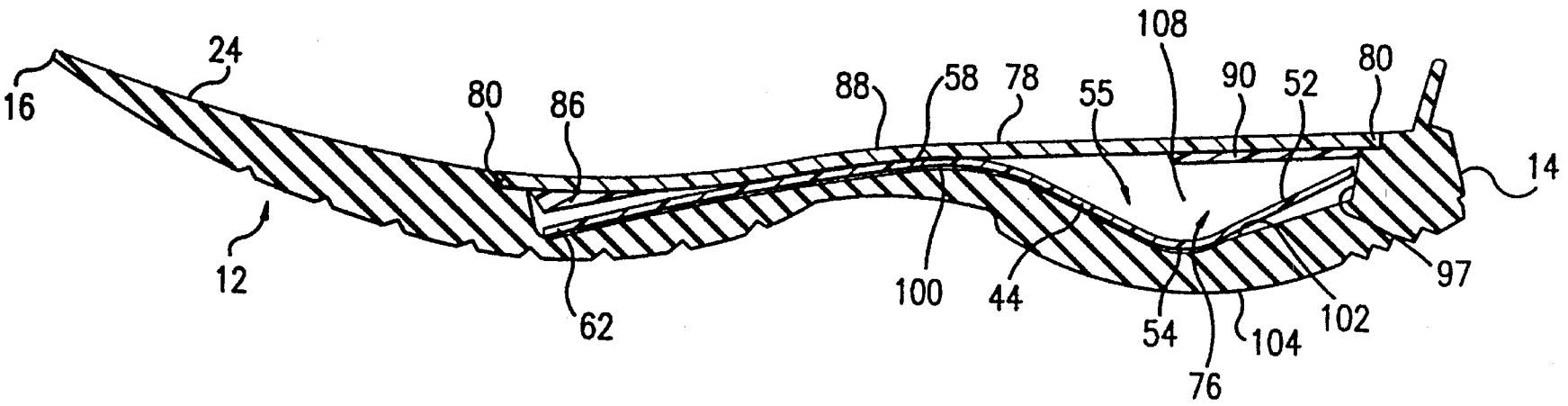
FIG. 13 is a side elevational view of a cross-section of a shoe sole incorporating the present invention.

A plate 78 covers the top of and further defines cavity 76. Plate 78 may comprise part of an outsole, midsole, insole or sockliner, or, as shown in FIGS. 12, 13 and 20, may be a separate element disposed within or above sole body 12. In the embodiment of FIGS. 12 and 13, plate 78 rests upon cavity 76 by way of ends 80 which fit within or rest upon complementary notches 82 in sole body 12. The bottom 84 of plate 78 includes a forward protrusion 86, a center section 88, and a rear protrusion 90. During the gait cycle, rear protrusion 90 engages heel lever 52 during heel strike. As the body weight shifts forwardly, center section 88 engages arch support surface 58. Toward the end of the gait cycle (i.e., toe-off), forward protrusion 86 engages arch decline surface 60 adjacent forward end 62 of insert 44. Plate 78 may be formed of plastic, or any suitably rigid material which will prevent the foot from "collapsing" into cavity 76. In this regard, plate 78 may act as a moderator of the impact forces of foot strike, and help control the flexing of insert 44. Plate 78 also controls the migration of the insert 44 within sole body 12.

Figure 14:
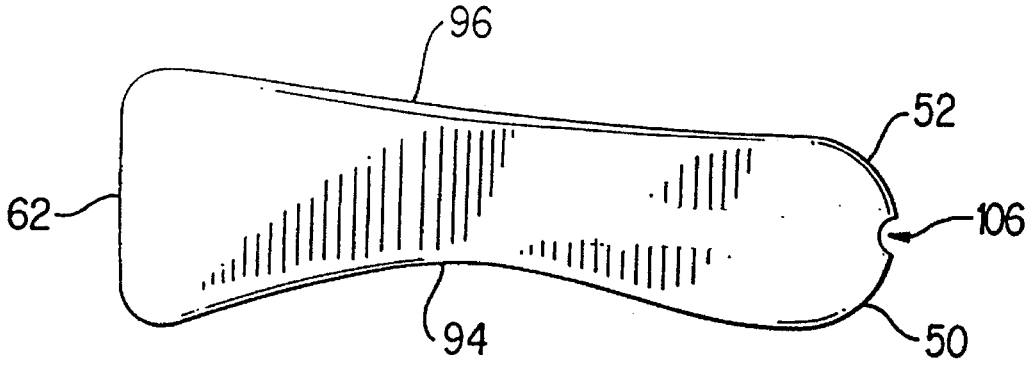
FIG. 14 is a top plan view of another embodiment of the insert of the present invention for incorporation within a shoe for the right foot.
Figure 15:
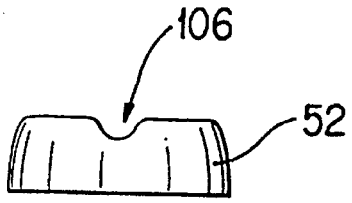
FIG. 15 is a rear view of the insert of FIG. 14.

The preferred embodiment of insert 44 is shown in FIGS. 14 and 15. Instead of fingers, insert 44 includes a semicircular indentation 106 formed with heel level 52 adjacent heel terminus 50. Rear protrusion 90 of plate 78 is shaped complementary to indentation 106, and engages and mates with indentation 106 during heel strike.

In operation of the present invention, the foot first contacts the ground during heel strike and all of the weight of the body is supported by the heel of the foot. Therefore, significant pressure is applied to the heel region of sole body 12 (including depressed heel area 104) causing the material forming sole body 12 to compress. Compression of the material is restrained by heel lever 52, which is supported at fulcrum 54, and heel incline surface 56. Energy from heel-strike is absorbed along heel lever 52 and is returned to the heel of the foot during heel lift-off. Energy from heel-strike is also absorbed by heel incline surface 56 causing heel incline surface 56 to move forward and flatten. This energy is returned to the arch of the foot during heel lift-off.

Before heel lift-off, as the weight of the body begins shifting toward the metatarsal bones, pressure on the heel region of sole body 12 is shifted toward heel incline surface 56, which further forces heel incline surface 56 toward toe end 16 of sole body 12. This force causes arch support surface 58 to further deflect, as does the longitudinal arch of the foot. Ideally, the deflection of arch support surface 58 should be identical to the deflection experienced by the longitudinal arch of the foot, i.e., arch support surface should flatten in the range of approximately 1–4 millimeters, and should lengthen approximately 4 millimeters.

As the weight of the body continues to be shifted from heel end 14 towards toe end 16, arch support surface 58 continues to flatten until it reaches its maximum deflection. At heel lift-off, when heel end 14 of shoe 10 leaves the ground, heel lever 52 biases toward its original non-compressed state, thereby returning the energy stored from heel-strike to the foot. At toe-off, when toe end 16 leaves the ground, arch support surface 58 begins to rise and shorten back to its original non-flexed configuration, thereby returning energy stored during heel-strike to the arch of the foot. Shoe 10 is then ready for the next heel-strike.

Hence, the present invention provides an insert for a foot support which cushions the foot, and aids in foot propulsion by responding to body weight shifting in the same manner as the inner longitudinal arch of a human foot.

The foregoing description of the preferred embodiment has been presented for purposes of illustration and description. It is not intended to be exhaustive or to limit the invention to the precise forms disclosed, and obviously many modifications are possible in light of the above teachings. For example, insert 44 may be flipped over or turned "upside down," such that heel support 48 comprises an inverted V-shape. In addition, instead of an elongated insert 44 extending forwardly to beneath either the metatarsal bones or the toe bones of the foot, a shortened plate which terminates rearwardly of these areas may be employed. FIGS. 19 and 20 disclose such an embodiment. Similar to the embodiment disclosed in FIGS. 12–18, insert 44 of FIGS. 19 and 20 is disposed within cavity 76. Insert 44 includes a V-shaped heel support, shown generally at 48. V-shaped heel support 48 includes heel terminus 50, fulcrum 54 and a forward terminus 51, and is defined by heel lever 52 and heel incline surface 56, which form a recess 55. Unlike forward end 62 of arch support surface 58, forward terminus 51 is not disposed beneath the metatarsal bones of the foot. Rather, forward terminus 51 is disposed adjacent the region where the heel merges with the longitudinal arch of the foot. The foregoing construction results in an "abbreviated" version of insert 44, which nonetheless stores and returns energy. Further, because fewer materials are needed to construct the insert of FIGS. 19 and 20, it is less expensive to manufacture than the "elongated" embodiment previously described.

As shown in FIG. 20, Plate 78 covers cavity 76. Plate 78 of FIG. 20 does not include forward protrusion 86 and rear protrusion 90, as protrusions 86 and 90 are optional to the present invention.

It should be understood that the foregoing disclosure relates only to presently preferred embodiments, and that it is intended to cover all changes and modifications of the invention herein chosen for the purpose of the disclosure which do not constitute departures from the spirit and scope of the invention as set forth in the appended claims.

What is claimed is:

1. A foot support comprising:

a sole body having a toe end, a medial side, a lateral side, and a heel end;

a substantially hollow cavity formed within said sole body, said cavity defined by two sidewalls, a front wall, a rear wall and an insert support surface; and a flexible insert disposed within and partially filling said cavity which responds to body weight shifting of the wearer in the same manner as the longitudinal arch of the foot of said wearer, said insert including (a) a forward end, a heel terminus, a lateral side and a medial side;

(b) a bottom surface shaped correspondingly to said insert support surface;

(c) a generally arcuate arch support surface which follows the contour of the longitudinal arch of the foot, disposed between said forward end and said heel terminus of said insert;

(d) a heel lever disposed between said arch support surface and said heel terminus at an angle to said arch support surface; and (e) a heel incline surface disposed between said heel lever and said arch support surface, wherein said heel incline surface and said heel lever define a substantially V-shaped heel support including a fulcrum at the junction of said heel incline surface and said heel lever which supports said heel support;

wherein said heel support absorbs energy from the impact of the foot of a user during heel strike and returns said stored energy to the foot of a user upon heel lift off.

2. The foot support of claim 1, wherein said insert is disposed on said insert support surface of said cavity.

3. The foot support of claim 1, further comprising a depressed heel area disposed adjacent said heel end of said sole body beneath said cavity.

4. The foot support of claim 1, wherein said sole body is formed of an elastomeric material.

5. The foot support of claim 4, wherein said elastomeric material comprises ethylene vinyl acetate (EVA).

6. The foot support of claim 1, wherein said insert is formed of a carbon-fiber composite.

7. The foot support of claim 6, wherein said carbon-fiber composite comprises carbon and glass.

8. The foot support of claim 1, further comprising a plate having a bottom disposed above said cavity.

9. The foot support of claim 8, wherein said plate is formed of plastic.

10. The foot support of claim 8, further comprising:

an indentation formed within said heel lever adjacent said heel terminus; and a protrusion disposed on said plate bottom, wherein said protrusion engages said indentation during heel strike.

11. The foot support of claim 1, wherein said sole body comprises a midsole.

12. The foot support of claim 1, further comprising fingers formed within said heel lever.

13. The foot support of claim 1, further comprising through holes formed within said insert.

14. The foot support of claim 1, further comprising a lateral curvature formed within said arch support surface and extending between said lateral side and said medial side of said insert.

15. The foot support of claim 1, wherein a portion of said insert is encapsulated within an elastomeric material.

16. A foot support comprising:

a sole body including a forward end and a heel end;

a substantially hollow cavity formed within said sole body, said cavity defined by two sidewalls, a front wall, a rear wall and an insert support surface; and a flexible insert disposed within and partially filling said cavity, said insert including (a) a forward end, a heel terminus, a lateral side and a medial side;

(b) a bottom surface shaped correspondingly to said insert support surface; and (c) a heel lever and a heel incline surface, wherein said heel lever and said heel incline surface define a substantially V-shaped heel support including a fulcrum at the junction of said heel incline surface and said heel lever which supports said heel support;

wherein said heel support absorbs energy from the impact of the foot of a user during heel strike and returns said stored energy to the foot of a user upon heel lift off.

17. The foot support of claim 16, further comprising a moderator disposed above said cavity which moderates the impact forces on said insert upon heel strike.

18. The foot support of claim 16, wherein said forward end of said insert is disposed adjacent the region where the heel of the foot of a user merges with the longitudinal arch.

19. The foot support of claim 16, wherein said insert is formed of a carbon-fiber composite.

20. The foot support of claim 16, wherein said insert is formed of a fiberglass material.

* * * * *